United States Patent [19]

Hahnewald et al.

[11] Patent Number: 4,918,294

[45] Date of Patent: Apr. 17, 1990

[54] ELECTRIC HEATING MEANS FOR A BREAD TOASTER

[75] Inventors: Andrea Hahnewald, Egelsbach; Georg Möthrath, Hasselroth, both of Fed. Rep. of Germany

[73] Assignee: Braun Aktiengesellschaft, Kronberg, Fed. Rep. of Germany

[21] Appl. No.: 272,647

[22] Filed: Nov. 17, 1988

[30] Foreign Application Priority Data

Nov. 27, 1987 [DE] Fed. Rep. of Germany ..... 3740298
Nov. 27, 1987 [DE] Fed. Rep. of Germany ..... 3740299

[51] Int. Cl.[4] ..... H05B 3/16; H05B 3/26

[52] U.S. Cl. ..... 219/521; 219/542; 219/546; 219/548

[58] Field of Search ..... 219/521, 532, 539, 520, 219/530, 531, 535, 538, 540, 542, 546, 548

[56] References Cited

FOREIGN PATENT DOCUMENTS 86950 1/1922 Fed. Rep. of Germany ..... 219/532
A 1615253 1/1972 Fed. Rep. of Germany .
2513580 10/1976 Fed. Rep. of Germany .
2520023 11/1976 Fed. Rep. of Germany .
A 2542944 3/1977 Fed. Rep. of Germany .

*Primary Examiner*—B. A. Reynolds
*Assistant Examiner*—Leon K. Fuller
*Attorney, Agent, or Firm*—Fish & Richardson

[57] ABSTRACT

The invention is directred to an electric heating in a bread toaster, comprising an insulating body (11) and heat conductor portions (14, 14') which may be arranged on both the front part and the back of the insulating body (11) and are pressed thereagainst by mounting strips (21). To compensate for uneven browning of the article to be toasted—which is caused by the bread toaster being cooled by an air current entering at its bottom and subsequently flowing mainly in the area of the center axis (X) of the insulating body (11)—, it is suggested to provide the mounting strips (21) on the insulating body (11) spaced from one center aixs (X) and thus substantially outside the range of action of the air current. In heating units referred to as center heating units in which the heat conductor portions (14, 14')—separated only by the insulating body (11)—cross each other along the center axis (X), high thermal loads and the attendant risks of scorching of the insulating body (11) and of electric short circuits are avoided by the invention.

10 Claims, 2 Drawing Sheets

ELECTRIC HEATING MEANS FOR A BREAD TOASTER

This invention relates to the mounting of a heat conductor on the insulating body of an electric heating means for a bread toaster. The majority of electric heating units for bread toasters used today is comprised of an insulating body having wire-shaped heat conductor portions mounted on one or both of its sides. To this end, the heat conductor is conventionally wound about the insulating body by a variety of methods.

A heating unit of this type which, in its capacity as a heating unit referred to as end heating unit has heat conductor portions only on its front part is known, for example, from German patent application No. DE-OS 2,520,023. To provide for additional securing of the heat conductor, a mounting strip made of insulating material is fastened to the front part of the heating means by means of several eyelets, with the mounting strip extending in the center of the insulating body from the bottom to the top and pressing the heat conductor portions against the insulating body.

From German patent application No. DE-OS 2,513,580 an electric heating unit for a bread toaster is known in which heat conductor portions are fitted to both sides of the insulating body. Heating units of this type which are referred to as center heating units are required for bread toasters having more than one slot for receiving the article to be toasted as, for example, a slice of bread, because in these bread toasters one heating unit toasts one side of two adjacent bread slices.

The heating unit described in No. DE-OS 2,513,580 is manufactured by passing a heat conductor from the front part to the back of the insulating body through a vertical slot provided at its upper end, with half of the conductor length extending from either side of the insulating body. A plurality of transversely extending slots are provided at equal levels on both lateral boundaries of the insulating body. Turning the insulating body about its center axis in helical fashion causes the heat conductor to be wound thereon, producing the heat conductor pattern as illustrated in the Figure on page 11 of the specification identified above. Separated only by the insulating body, the heat conductor portions cross each other in the center axis thereof. In this known heating unit, mounting strips extend on both sides of the insulating body longitudinally of the center axis and thus over the crossing points.

Considering that the heat conductor portions expand on heating as a result of which they move both forward in the direction of the article being toasted and sag downward due to gravity, the fitting of mounting strips serves the purpose of locating the heat conductor portions alongside the mounting strip and thereby limiting their position change. The bread toasters nowadays used conventionally have a slot width of about 130 mm, which requires an insulating body of approximately the same dimension. The known arrangements thus make it possible for a heat conductor to freely suspended over a distance of about 60 mm.

Because in the known arrangements the heat conductor portions do not attain the customary operating temperature of about 900° C. in the area of the mounting strip beyond its width of between 6 and 12 mm, approximately, they contribute insufficiently to the browning of the article being toasted. From this results the disadvantageous typical browning pattern of a slice of toast bread, showing a broad vertical area in the center thereof which is browned a distinctly lighter color.

It is a further disadvantage of the known arrangement that the high amount of expansion and sag of the heat conductor portions incurred by the use of a prior-art mounting means affects the toasting result equally adversely, because radiating areas with high temperatures are situated in close proximity to the article being toasted, whilst radiating areas with lower temperatures (in the area of the mounting strips) are at a greater distance from the article being toasted.

Uneven browning of the article being toasted which occurs as a result of the position changes due to expansion of the heat conductor portions is intensified still more by cool air being drawn in in the bottom area of the electric bread toaster, the air concentrating in the bottom center area of the article being toasted due to fluid flow and hardware conditions. The cooling effect occurring in the bread toaster by outside air entering at the bottom part of its housing due to the stack effect, which air, after having taken up heat, exits again through the toast receiving slots, is particularly effective in the air entrance area, that is, in the bottom area of the heating unit. In this area, the air current therefore delays heating of the article being toasted still further. Accordingly, the heating unit would be required to supply more energy for the bottom center area of the article being toasted.

For this reason, the heating unit known from No. DE-OS 2,520,023 has in its bottom area in vertical direction heat conductor portions spaced materially more densely than in its top area (cf. FIG. 2). The purpose of this arrangement is to compensate for the inhomogeneous cooling in vertical direction, so that the effective heating power acting on the article being toasted (due to radiation and heat conduction) is approximately homogeneous in vertical direction. From this results that the known bread toaster heating unit, taking into account the cooling effect, has a substantially homogeneous power density in vertical direction, while in horizontal direction the power density is distinctly inhomogeneous in an arrangement in which the heat conductor is mounted by means of a single mounting strip extending on the center axis of the insulating body or by means of staples equally provided on this axis.

In a center heating unit, still further disadvantages result from the mounting strips extending across the crossing points. First, the contact between heat conductor and insulating body causes high thermal loads locally on both sides of the insulating body which increases the risk of the backing material becoming scorched. Furthermore, such scorched spots may cause the crossing heat conductor portions which are only separated by the insulating body to come into electrical contact with one another, producing a short circuit causing failure of the heating unit.

It was therefore an object of the present invention to provide an electric heating means for a bread toaster which affords a substantially homogeneous power density also in horizontal direction, with the bread toaster being cooled by an air current entering at its bottom, flowing subsequently mainly over the center area of the heating means, and finally exiting again through the toaster slot. It is a further object of the invention to provide a center heating unit in which, for one thing, the risk of local scorching of the insulating body is reduced, and in which for another thing the danger of an electric short circuit between the heat conductor portions extending on the front part and the back of the insulating body can be nearly eliminated should scorching have occurred already.

These requirements are satisfied for a heating means according to the preamble of patent claim 1 by the features identified in the characterizing part thereof.

First, by arranging the mounting means spaced from the center axis as disclosed in the invention, it is prevented that uneven browning of the article being toasted, which occurs anyway due to the necessary cooling of the bread toaster, is still more intensified. Furthermore, a compensation is provided also in horizontal direction, that is, normal to the center axis of the insulating body, such that heat conductor areas lying in toaster zones cooled to a greater degree supply more power, in addition to being in greater proximity to the article being toasted, than areas lying in zones cooled to a lesser degree.

Still further, in center heating units local overheating of the backing material can only occur on one side of the insulating body, which is due to the fact that mounting means are provided spaced from the center axis on the front part and on the back of the insulating body. This reduces the risk of local scorching of the backing material. The useful life of a center heating unit according to the invention is thereby prolonged materially if its power output is to remain unchanged or, alternatively, the center heating unit can be operated at a substantially higher power while the useful life remains approximately unchanged.

In addition, the center heating unit of the invention affords the advantage that also in the event of one or several local scorched spots alongside the mounting means there are no heat conductor portions extending on the opposite side of the insulating body. This practically obviates the possibility of an electric short circuit.

In an advantageous embodiment of the invention, the mounting means are formed as continuous strips (claim 2)—as already known per se from No. DE-OS 2,520,023—, which strips may be arranged in pairs and symmetrically to the center axis (claim 3).

A particularly effective compensation is accomplished if in the upper and less cooled are of the insulating body the continuous mounting strips are in greater proximity to its center axis than in the lower area cooled to a greater degree (claim 4).

As is equally known per se from No. DE-OS 2,520,023, the mounting means may also be formed as individual staples which embrace the heat conductor and are pressed into the insulating body (claim 5). In this embodiment, a particularly effective compensation can be accomplished if the mounting means, for reducing the power output of the heat conductor area concerned, are specifically provided in such areas where particularly high power peaks occur, in order to diminish the power output in these areas.

Reference is now made to the accompanying drawing showing two embodiments of the invention, in which.

Figure 1:
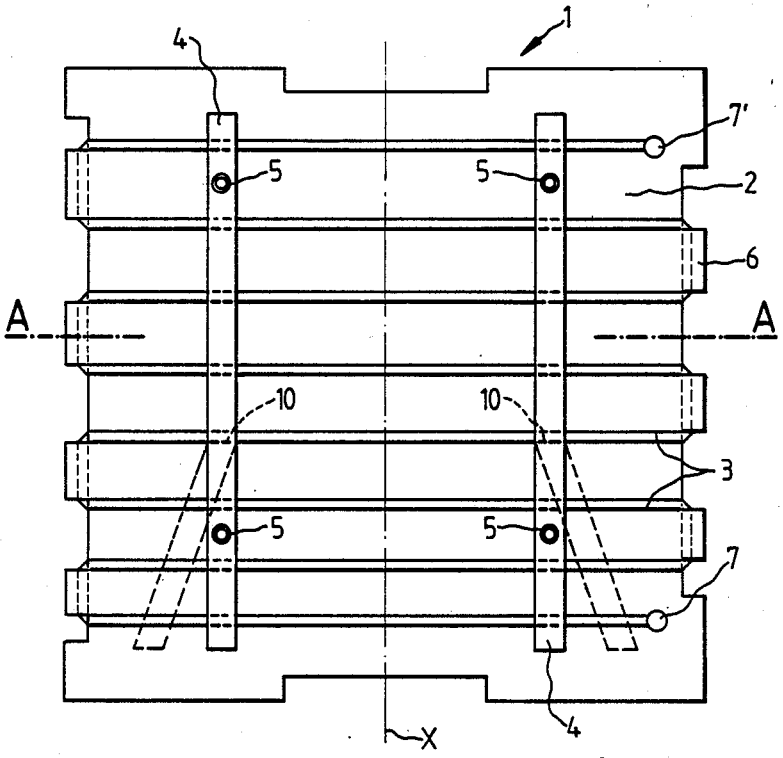
FIG. 1 is a front view of the heating means of the invention, taking a heating unit referred to as end heating unit as an example.
Figure 2:
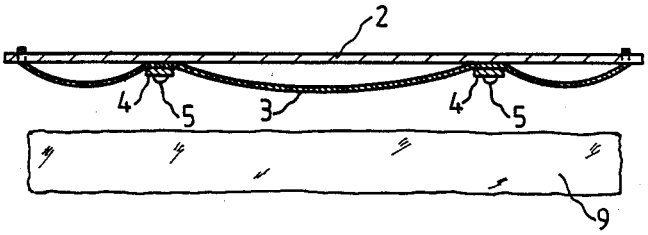
FIG. 2 is a sectional view taken along line A—A of the heating means illustrated in FIG. 1.

The heating means 1 of FIGS. 1 and 2 is comprised of an insulating body 2 on which heat conductor portions 3 are provided only on its front part. The heat conductor portions 3 may be fitted to the insulating body 2, for example, by welding a heat conductor of suitable length to an electrical terminal 7 riveted to the insulating body 2, guiding it subsequently across the width of the insulating body 2, returning the heating wire after having wrapped it around one of the projections 6 formed on the insulating body 2, wrapping it around the next projection 6, and finally welding the heating wire to a second electrical terminal 7', cutting off its projecting end. As shown in FIG. 1, the second terminal 7' may be likewise riveted to the front part of the insulating body 2.

In accordance with the invention, the heat conductor portions 3 are held down by two mounting strips 4 extending at a distance from the center axis X of the insulating body 2. The mounting strips 4 in turn are each securely fastened to the insulating body 2 by means of two rivets 5. This arrangement of the mounting strips 4 produces the sag profile shown in FIG. 2 when the heat conductor portions 3 become heated. Due to this sag profile, the heat conductor portions 3 lie in greater proximity to a bread slice 9 to be toasted in the more strongly cooled area directly around the center axis X, thus compensating for the cooling effect. Conversely, the heat conductor portions 3 in the less cooled areas are spaced a greater distance from the bread slice 9, which is equally desirable in the interest of compensation.

Further, the maximum amount of sag of the heat conductor portions 3 when held down by two mounting strips 4 spaced from the center axis X is smaller, which provides for an adjustment of the toasting degree of the bread slice 9 between the areas exposed to maximum and minimum heating power delivered by the heat conductor portions 3.

In summary, it has to be stated that areas of the bread slice 9 cooled to a greater degree are subjected to a higher heating power than areas cooled to a lesser degree, whereby—when viewed horizontally—a more even browning of the bread slice 9 is accomplished. In addition to the known compensation in vertical direction, the arrangement of the mounting strips 4 spaced from the center axis as disclosed in the invention thus affords also compensation in horizontal direction for bread toasters cooled preferably in the area of the center axis X.

An even better designed adjustment of the heating power acting on the bread slice 9 can be accomplished if the mounting strips 4 are in closer proximity to the center axis X in the upper area of the insulating body 2 than in the bottom area (in FIG. 1 position shown in broken lines). In this arrangement, the mounting strips 4 have a bent portion 10 approximately in the middle of the insulating body 2. This manner of fastening makes allowance for the fact that the cooling effect in the bottom area of the insulating body 2 is greater than in its upper area in which the cool air has already become heated.

A still further adjustment of the heating power acting on the bread slice 9 can be accomplished by the use of staples holding the heat conductor portions 3 down at certain points in the areas of maximum heating power acting on the bread slice 9, with the staples being pressed into the insulating body 2.

Figure 3:
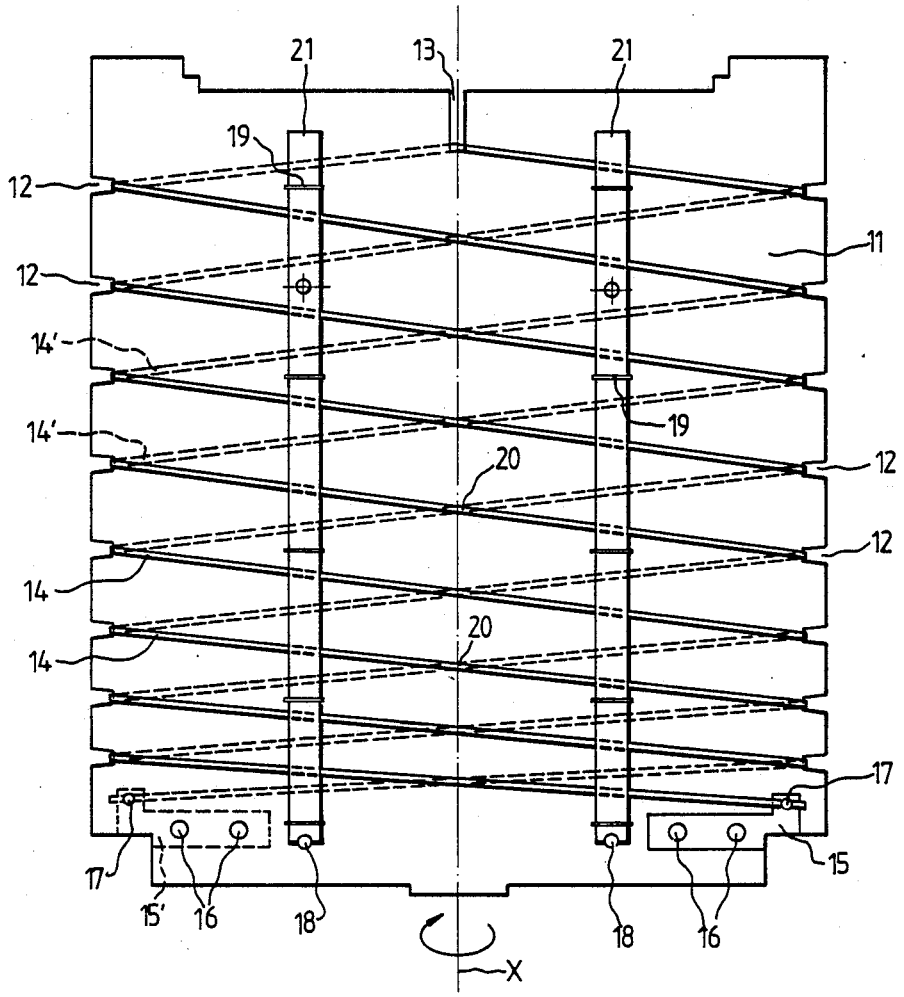
FIG. 3 is a front view of the heating means of the invention, taking a heating unit referred to as center heating unit as an example.

The heating means shown in FIG. 3 shows an insulating body 11 on which heat conductor portions 14 and 14' are mounted. In this arrangement, the heat conductor portions designated by reference numeral 14 are mounted on the front part of the insulating body 11, while the heat conductor portions designated by reference numeral 14' extend on its back. The heating unit involved is referred to as a center heating unit for a bread toaster, in which heat is to be emitted on both sides of the insulating body 11. The heating means shown may be manufactured by the following known method, for example:

An integral piece of heat conductor of appropriate length is guided through an indentation 13 of the insulating body 11 such that a piece of equal length extends from the insulating body 11 on both the front part and the back. The insulating body 11 is then turned about its center axis X in the direction identified by an arrow while being moved in upward direction at the same time. The insulating body 11 thus performs a helical movement about its center axis X. The lead of the helix is selected such that the heat conductor passes through notches 12 provided at the sides of the insulating body 11. With the insulating body 11 wound completely, the heat conductor is mechanically and electrically connected to terminals 15, 15' provided on the front part and the back, respectively, by means of spot welds 17. The terminals 15 and 15' may be secured to the insulating body 11 by means of rivets 16. In a heating means manufactured in this manner, the heat conductor portions 14 and 14', being only separated by the insulating body 11, cross each other at several crossing points 20 which lie all on the center axis X.

The insulating body 11 is subjected to a particularly high thermal load locally at the crossing points 20. Therefore, in accordance with the invention, the mounting structure for the heat conductor portions which is required in order to limit the sag of the heat conductor portions 14 and 14' occurring due to thermal expansion and gravity, is provided by two mounting strips 21 of insulating material extending at a relative distance to the center axis X. The two mounting strips 21 which are fitted to the front part and the back of the insulating body 11 are secured by means of rivets 18 and/or by means of staples 19 pressed into the insulating body 11.

By fitting the mounting strips 21 as disclosed in the invention, the heat conductor portions 14 and 14' are invariably pressed against only one side of the insulating body 11, whereby only this one side is subjected to local thermal loads. In consequence, scorched spots are unlikely to occur. However, even in the event that the insulating body 11 should become scorched at such a spot, an electric short circuit cannot occur because the heat conductor portions 14 and 14' are not opposite each other in areas subjected to special thermal loads locally.

If the heat conductor portions 14 and 14' are held down on the insulating body 11 by individual staples only, the areas of local thermal load can be determined at such relative distances that the risk of scorching of the insulating body 11 is reduced still further.

I claim:

1. A bread toaster having a housing with at least one air inlet opening at its bottom and at least one slot for accepting and ejecting the article to be toasted, an insulating body in said housing, said insulating body having a center axis (X), and being cooled by an air current that enters through said air inlet opening, flows subsequently mainly over the area of said center axis of said insulating body, and finally exits through said slot, heat conductor portions arranged on at least one side of said insulating body, and mounting means arranged on said insulating body spaced from said center axis (X) and thus substantially outside the range of action of said air current and securing said heat conductor portions on said insulating body, said heat conductor portions being secured on said insulating body with a sag profile such that said heat conductor portions are spaced a greater distance from said insulating body in the area of said center axis and said air current than in the area of said mounting means whereby—when viewed horizontally—a more even browning of the article to be toasted is accomplished.

2. A toaster as claimed in claim 1 wherein said mounting means are continuous strips arranged in pairs and symmetrically to the center axis (X).

3. A toaster as claimed in claim 2 wherein said mounting strips extend parallel to the center axis (X) of the insulating body (2, 11).

4. A toaster as claimed in claim 2 wherein at the edge of said insulating body close to said slot, said mounting strips are in greater proximity to the center axis (X) than at the edge close to said air inlet opening.

5. A toaster as claimed in claim 1 wherein said mounting means are formed as individual staples which embrace the heat conductor portions and are pressed into said insulating body.

6. A toaster as claimed in claim 5 wherein the arrangement of said staples on said insulation body is chosen in such a manner that they are provided in areas in which a reduction of the heating power delivered by the respective heat conductor portions is particularly desirable.

7. A toaster as claimed in claim 1 wherein said insulating body is a planar member and has projections on opposite edges thereof and said heat conductor portions are sequentially wrapped around said projections.

8. A toaster as claimed in claim 1 wherein said insulating body is a planar member and said heat conductor portions are wound around said insulating body in helix configuration, the heat conductor portions on opposite sides of said insulating body crossing each other at crossing points that lie on said central axis (X).

9. A toaster as claimed in claim 8 wherein said mounting means are continuous strips arranged in pairs and symmetrically to said center axis (X).

10. A toaster as claimed in claim 8 wherein said mounting means are formed as individual staples which embrace the heat conductor portions and are pressed into said insulating body.

* * * * *

UNITED STATES PATENT AND TRADEMARK OFFICE

CERTIFICATE OF CORRECTION

PATENT NO. : 4,918,294

DATED : April 17, 1990

INVENTOR(S) : Andrea Hahnewald, et al.

It is certified that error appears in the above-identified patent and that said Letters Patent is hereby corrected as shown below:

In the Abstract, "directred" should be --directed--;
line 1, after "heating" insert --means for use--;
line 12, "aixs" should be --axis--.
line 12, "one" should be --the--

Col. 3, lines 4-6, delete in its entirety;
lines 37-41, delete in its entirety;
line 46, delete "(claim 4)";
line 50, delete "(claim 5)".

Signed and Sealed this

Second Day of July, 1991

*Attest:*

HARRY F. MANBECK, JR.

*Attesting Officer*

*Commissioner of Patents and Trademarks*